US007575492B2

(12) United States Patent
Miura

(10) Patent No.: US 7,575,492 B2
(45) Date of Patent: Aug. 18, 2009

(54) MUFFLER SUPPORT STRUCTURE FOR A SMALL BOAT

(75) Inventor: Takayoshi Miura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/371,001

(22) Filed: Mar. 9, 2006

(65) Prior Publication Data

US 2006/0205294 A1 Sep. 14, 2006

(30) Foreign Application Priority Data

Mar. 11, 2005 (JP) ..... 2005-069206

(51) Int. Cl.
*F01N 7/00* (2006.01)

(52) U.S. Cl. ..... 440/89 J

(58) Field of Classification Search ..... 440/89 J
See application file for complete search history.

(56) References Cited

U.S. PATENT DOCUMENTS 5,329,074 A * 7/1994 Alexander ..... 181/235
5,699,749 A * 12/1997 Yamada et al. ..... 114/55.51
5,959,262 A * 9/1999 Menzel ..... 181/231
6,206,741 B1 * 3/2001 Matsuda ..... 440/89 R
6,415,728 B1 * 7/2002 Maeda et al. ..... 114/55.5
2004/0060763 A1 * 4/2004 Stodolka ..... 180/309

FOREIGN PATENT DOCUMENTS

JP 2004-114947 A 4/2004

* cited by examiner

*Primary Examiner*—Stephen Avila
(74) *Attorney, Agent, or Firm*—Birch, Stewart, Kolasch & Birch, LLP

(57) ABSTRACT

A muffler support mechanism for a small boat is capable of reducing the number of parts required to fix a water muffler. The muffler support mechanism includes a second water muffler mounted on a left recess of a support plate. A bracing flotation member is mounted on an upper part of the rear half of the second water muffler. A bonding surface of a deck of the small boat is bonded to a bonding surface of the hull. As a result, an upper end of the bracing flotation member is pressed by the deck. The second water muffler is pushed into the left recess by the bracing flotation member.

25 Claims, 7 Drawing Sheets

MUFFLER SUPPORT STRUCTURE FOR A SMALL BOAT

CROSS-REFERENCE TO RELATED APPLICATIONS

This nonprovisional application claims priority under 35 U.S.C. § 119(a) on Patent Application No. 2005-069206, filed in Japan on Mar. 11, 2005, the entirety of which is incorporated herein by reference.

BACKGROUND OF THE INVENTION

1. Field of the Invention

The present invention relates to a muffler support structure for a small boat. A boat body includes a hull and a deck covering the hull. A muffler is provided within the boat body.

2. Description of Background Art

Small boats exist that have a boat body including a hull that constitutes a lower part of the boat body that is covered by a deck that constitutes an upper part of the boat body. An engine is provided within the boat body. A water jet pump is then fitted to the rear section of the boat body. Water is sucked in from the boat bottom as a result of driving a water jet pump using the engine. The water is blasted to the rear so that the small boat glides.

A small boat that glides using a water jet pump is equipped with a water muffler at an exhaust pipe of the engine. A flotation member is provided within the boat body. The water muffler reduces exhaust noise due to exhaust gases from the engine and prevents the water from permeating. The flotation member is a floating member for ensuring buoyancy of the boat body (for example, see Japanese Patent Laid-open Publication No. 2004-114947).

A water muffler within a boat body can be fixed to the hull using a rubber band, for example. Specifically, the rubber band collides with the peripheral wall of the water muffler and the ends of the rubber band are fitted to fitting jigs via respective stays. The water muffler is then fixed to the hull by fitting the fitting jigs to the hull using rivets.

SUMMARY OF THE INVENTION

However, with the small boat of the background art, a rubber band, a pair of stays, a pair of fitting jigs and a plurality of rivets are necessary to fix the water muffler. Because of this, numerous parts are required to fix the water muffler. This increases the cost of the small boat.

It is therefore advantageous for the present invention to provide a muffler support mechanism for a small boat that is capable of reducing the number of parts that fix a water muffler.

According to a first aspect of the present invention, a muffler support structure for a small boat with a boat body having a hull that constitutes a lower part of the boat body and a deck that constitutes an upper part of the boat body. The deck covers the hull. A flotation member is provided as buoyancy material within the boat body. An engine is mounted in the boat body. An exhaust pipe is fastened to the engine and a muffler is provided midway along the exhaust pipe. The flotation member is interposed between the muffler and the deck, and the muffler is fixed using the flotation member.

A flotation member is interposed between the muffler and the deck and the muffler is fixed using the flotation member. The flotation member is a member that is necessary as a buoyant material for the boat body. It is then possible to reduce the members required to fix the muffler by fixing the muffler using the flotation member.

According to a second aspect of the present invention, the muffler is pushed towards the hull side by the flotation member while the hull is covered by the deck.

The muffler is fixed as a result of the muffler being pushed towards the hull side by the flotation member while the hull is covered by the deck. Therefore, it is possible to simplify the manufacturing process for fixing the muffler.

According to a third aspect of the present invention, a first member of the flotation member supports the lower part of the muffler and is supported by the hull, and a second member of the flotation member supports the upper part of the muffler and is supported by the deck.

The first member of the flotation member supporting the lower part of the muffler is supported by the hull and the second member of the flotation member supporting the upper part of the muffler is supported by the deck. In this way, it is possible for the flotation member to be supported using a simple shape by supporting the muffler using two members.

According to a fourth aspect of the present invention, the muffler is a water muffler containing cooling water inside.

Cooling water is contained within the water muffler. It is therefore possible to cool the water muffler using cooling water and prevent the water muffler from reaching high temperatures. As a result, the flotation member supporting the water muffler does not reach high temperatures. This means that it is possible to form the flotation member using materials that are not particularly resistant to high temperatures and the costs can therefore be kept low.

According to the first aspect of the present invention, the muffler is fixed using the flotation member. This means that the number of parts required to fix the muffler can be reduced and costs can be kept down.

According to the second aspect of the present invention, the muffler can be fixed using a simplified manufacturing process and productivity can therefore be increased.

According to the third aspect of the present invention, it is possible to keep the shape of the flotation member simple, and the cost of the flotation member can therefore be kept down.

According to the fourth aspect of the present invention, it is possible to form the flotation member from a material that has low resistance to high temperatures, and costs of the flotation member can therefore be kept down.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
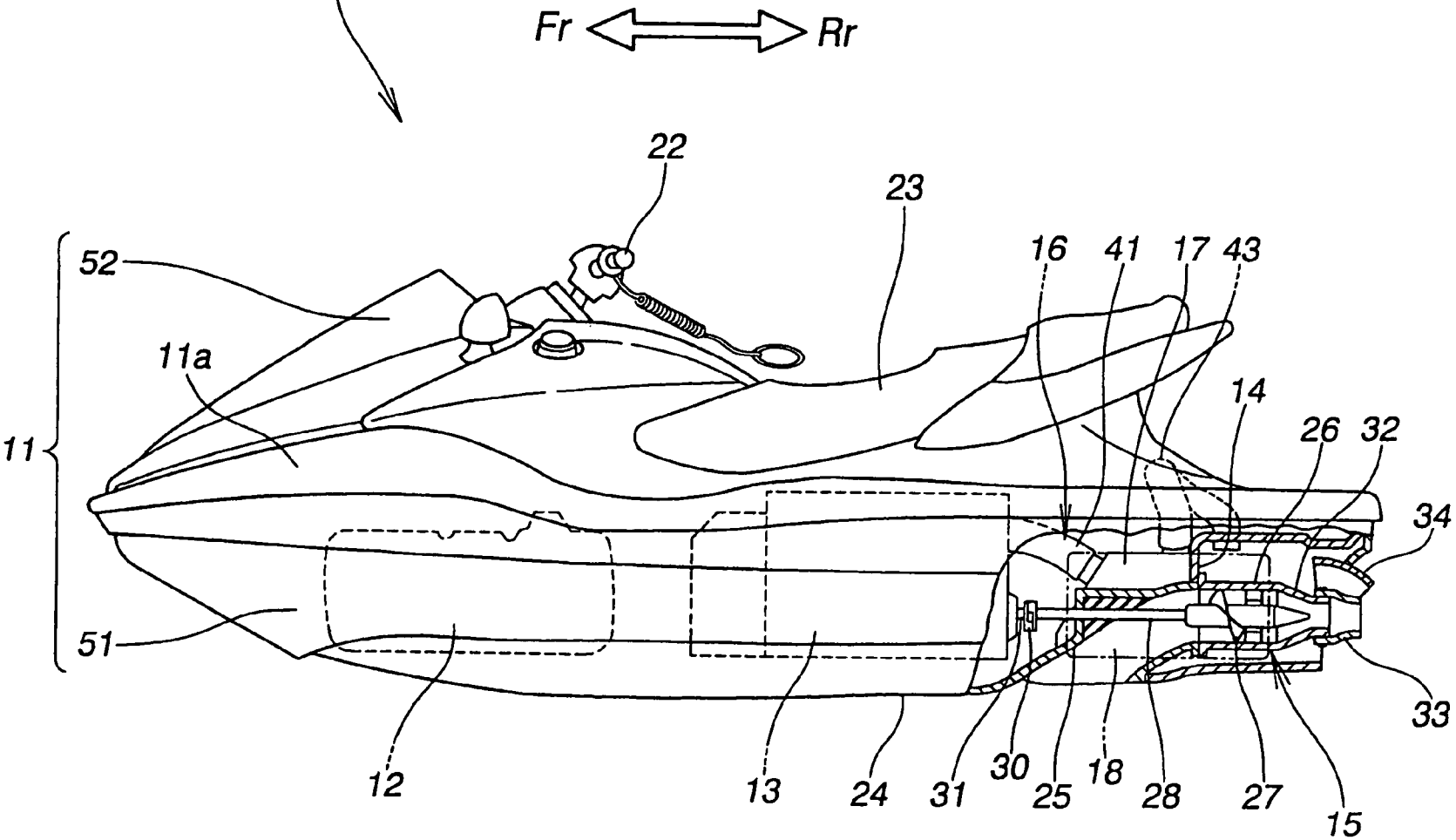
FIG. 1 is a side view showing a small boat equipped with a muffler support structure of the present invention.

The present invention will now be described with reference to the accompanying drawings, wherein the same or similar elements will be identified with the same reference numerals.

The following is a description of preferred embodiments of the present invention based on the attached drawings. In the following description, the terms "front", "rear", "left" and "right" are all taken to be from the driver's perspective, wherein "Fr" is the front side, "Rr" is the rear side, "L" is the left side, and "R" is the right side.

FIG. 1 is a side view of a small boat equipped with a muffler support mechanism of the present invention. The small boat 10 is a water jet ski equipped with a fuel tank 12 at a front section 11*a* of a boat body 11. An engine 13 is attached to the rear of the fuel tank 12. A pump chamber 14 is attached to the rear of the engine 13. A water jet pump 15 is attached to the pump chamber 14. A first water muffler 17 and second water muffler (muffler) 18 are fitted to the intake side of an exhaust pipe 16 at the engine 13. An exhaust output side of the exhaust pipe 16 faces the inside of the pump chamber 14 and is provided midway along the exhaust pipe 16. The second water muffler 18 is supported by a muffler support structure 20 (refer to FIG. 5). A steering handlebar 22 is fitted at an upper part of the fuel tank 12. A seat 23 is fitted to the rear of the steering handlebar 22.

The water jet pump 15 is such that a housing 26 extends from an inlet port 25 of the boat bottom 24 to the rear. An impeller is fitted in a freely rotating manner within the housing 26. A propeller shaft 28 is provided at the impeller 27. The propeller shaft 28 is coupled to the drive shaft 31 of the engine 13 via a coupling joint 30.

With the water jet pump 15, it is possible to blast water sucked in from the inlet port 25 of the boat bottom 24 from a steering nozzle (steering nozzle) 33 via a rear section nozzle 32 of the housing 26 to the rear of the boat body 11 by having the engine 13 drive the impeller 27 in such a manner as to make the impeller 27 rotate.

When the small boat 10 reverses, a reverse bucket 34 at an upper part of the steering nozzle 33 moves to a reverse position to the rear of the steering nozzle 33. As a result, blasted water blasted to the rear from the steering nozzle 33 is made to pass to the front of the boat body 11 by the reverse bucket 34 and the small boat is propelled to the rear by the passing blast of water.

Figure 2:
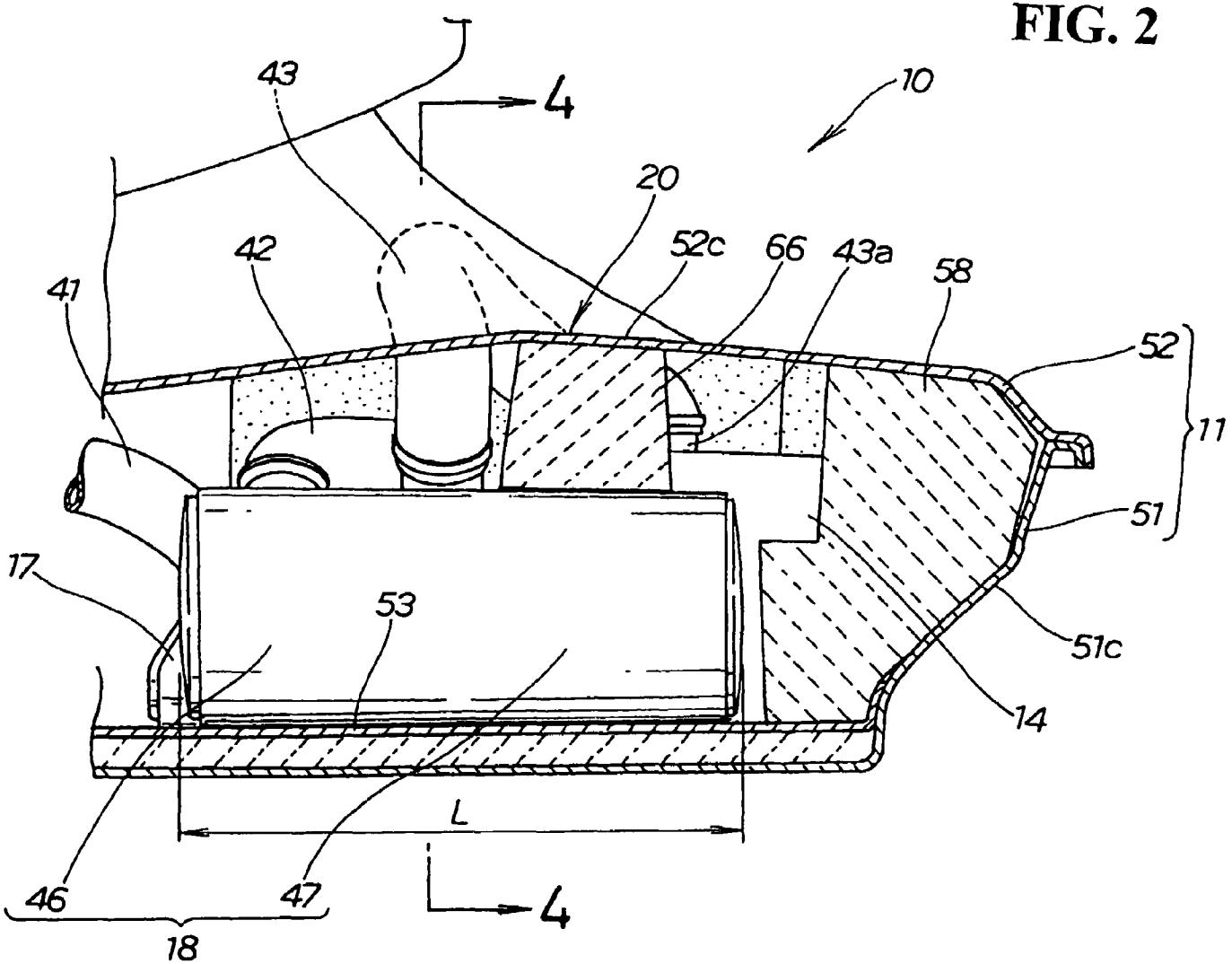
FIG. 2 is a side view showing a muffler support structure for a small boat of the present invention.
Figure 3:
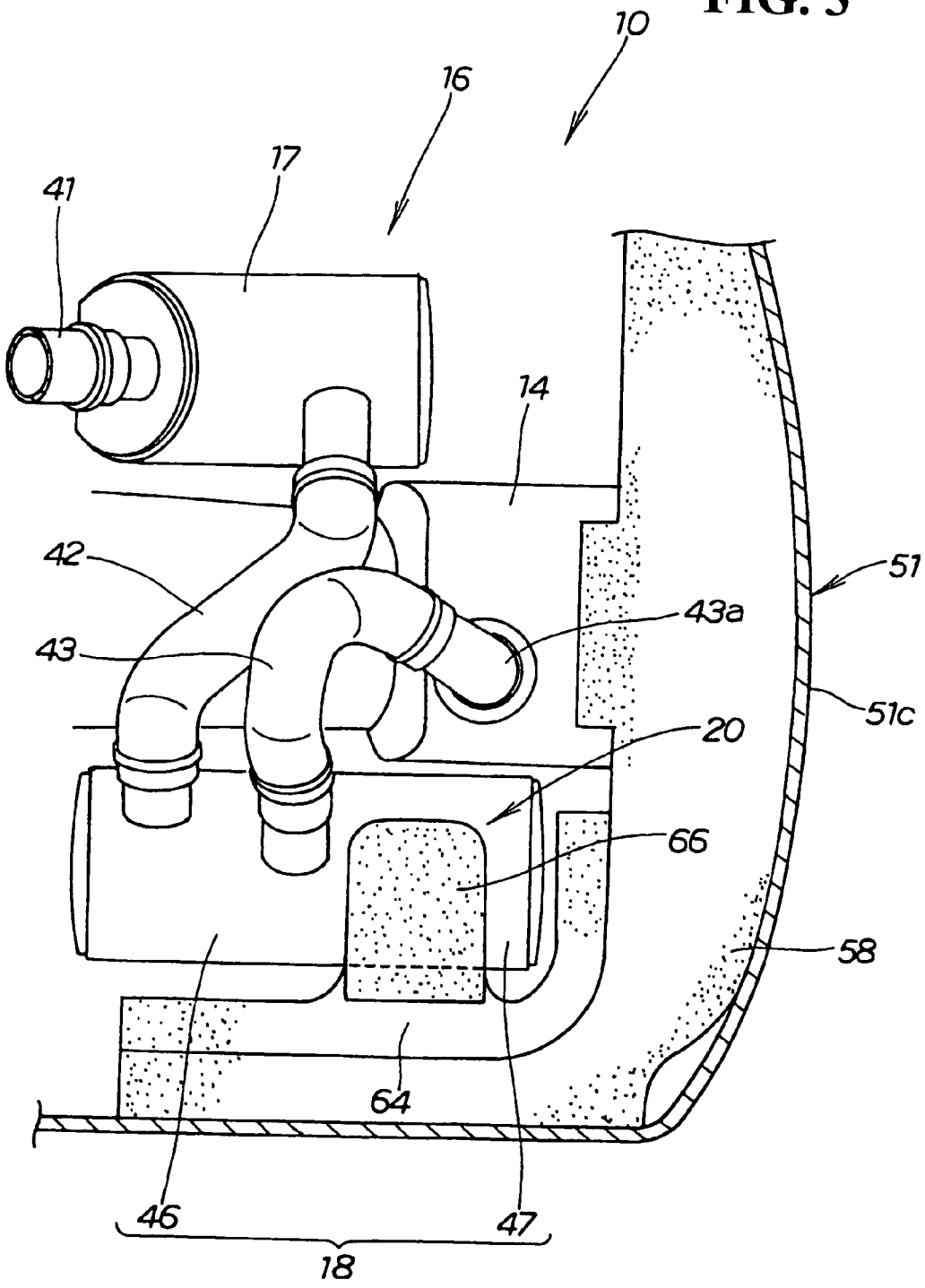
FIG. 3 is a plan view showing a muffler support structure for a small boat of the present invention.

FIG. 2 is a cross-sectional view showing a muffler support structure for a small boat of the present invention. FIG. 3 is a plan view showing a muffler support structure for a small boat of the present invention. The exhaust pipe 16 has a first exhaust pipe 41 extending from an exhaust manifold of the engine 13 (refer to FIG. 1) to the rear of the boat body 11. The first water muffler 17 is coupled to the first exhaust pipe 41. The second water muffler 18 is coupled to the first water muffler 17 via the second exhaust pipe 42. The end 43*a* of the third exhaust pipe 43 is fitted to a ceiling of the pump chamber 14, and the end 43*a* faces the inside of the pump chamber 14. The second water muffler 18 is a member provided midway along the exhaust pipe 16.

The first and second water mufflers 17 and 18 constitute a muffler configured to prevent water from permeating to the side of the engine 13. Cooling water is contained within the first and second water muffler 18.

The exhaust gas exhausted from the engine 13 passes within the first water muffler 17 via the first exhaust pipe 41, passes through the second exhaust pipe 42, and is guided to the second water muffler 18. The exhaust gas guided to the second water muffler 18 is then exhausted from the end 43*a* via the third exhaust pipe 43 to within the pump chamber 14.

The second water muffler 18 is formed so that the overall length is comparatively long. The second and third exhaust pipes 42, 43 are coupled to a member 46 at the front half of the second water muffler 18. The member 47 at the rear half of the second water muffler 18 is supported by the muffler support mechanism 20 of the small boat.

Figure 4:
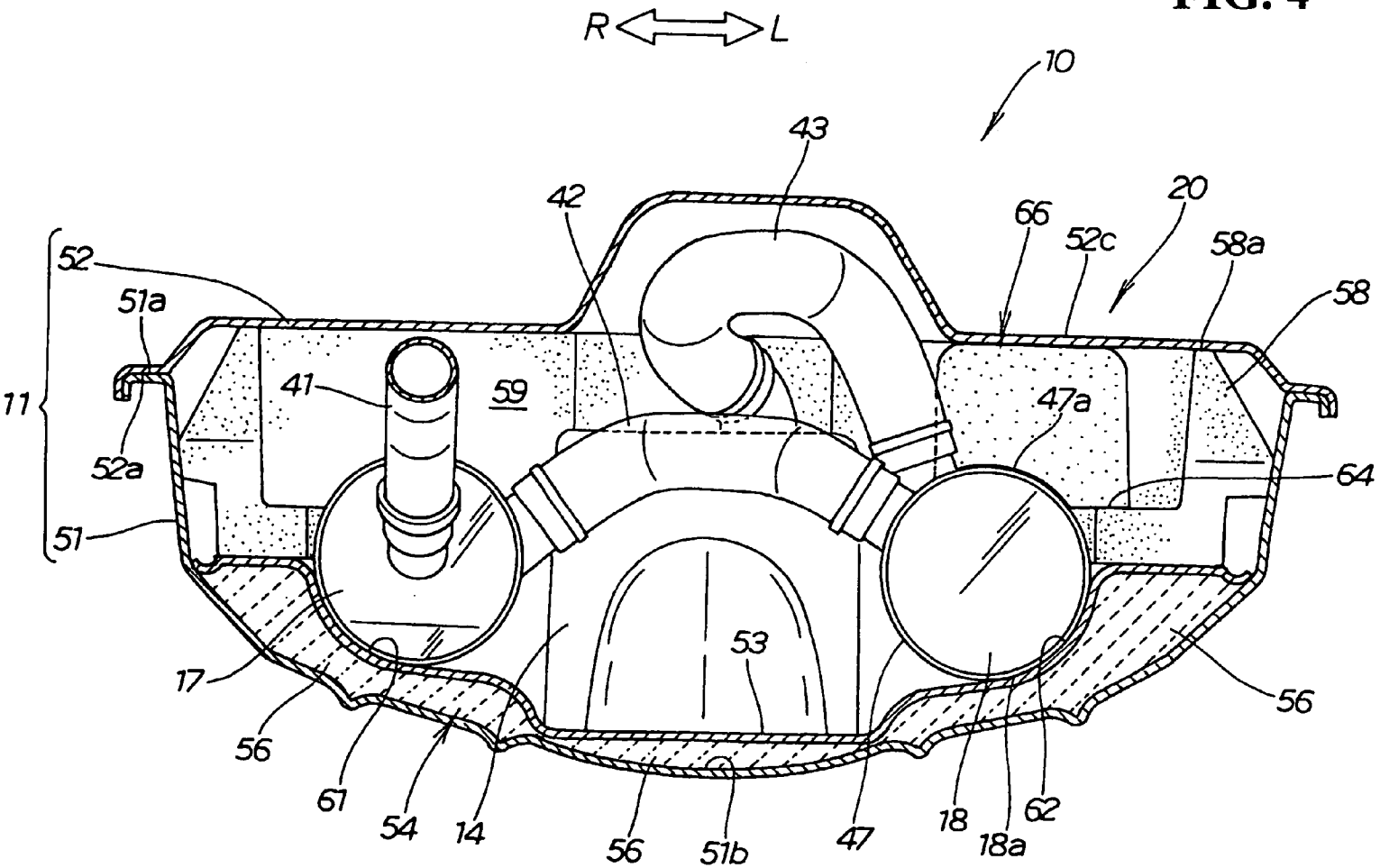
FIG. 4 is a cross-sectional view along line 4-4 of FIG. 2.

FIG. 4 is a cross-sectional view along line 4-4 of FIG. 2. The boat body 11 is equipped with a hull 51 constituting a lower section and a deck 52 constituting an upper part. The hull 51 is covered by the deck 52 by bonding a bonding surface 52*a* of the deck 52 to the bonding surface 51*a* of the hull 51 using adhesive (not shown).

A support plate 53 is fitted to the rear surface 51*b* of the hull 51. A space 54 is formed between the hull 51 and the support plate 53. A bottom section flotation member (flotation member) 56 is provided at this space 54. Furthermore, the boat body 11 is equipped with an external periphery flotation member 58 at the space 59 within the boat body 11.

The bottom section flotation member 56 and the outer periphery flotation member 58 together form a member that is used as a flotation member provided within the boat body 11.

A right recess 61 is formed at a right end of the support plate 53 and a left recess 62 is formed at a left end of the support plate 53. The first water muffler 17 is mounted on the right recess 61 and the second water muffler 18 is mounted on the left recess 62.

The first water muffler 17 is arranged at the support plate 53 in a stable manner as a result of being mounted on the right recess 61. Similarly, the second water muffler 18 is arranged at the support plate 53 in a stable manner as a result of being mounted on the left recess 62.

The external periphery flotation member 58 is aligned with a peripheral edge 51*c* (refer to FIG. 2, FIG. 3) of a rear section of the hull 51 and is aligned with the support plate 53. The external periphery flotation member 58 is equipped with a recess 64 aligned along the second water muffler 18.

An upper end 58*a* of the external periphery flotation member 58 is pressed by the deck 52 as a result of the bonding surface 52*a* of the deck 52 being bonded to the bonding surface 51*a* of the hull 51. As a result, the external periphery flotation member 58 is sandwiched by the support plate 53 (hull 51) and the deck 52.

Furthermore, a lower section (lower section of the muffler) 18*a* of the second water muffler 18 is supported by the bottom section flotation member 56 via the support plate 53 as a result of the bonding surface 52*a* of the deck 52 being bonded to the bonding surface 51*a* of the hull 51. An upper section 47*a* of the second water muffler 18 is supported by a bracing flotation member (flotation member) 66. As a result, the second water muffler 18 is supported in a fixed state within the boat body 11.

The bottom section flotation member 56 supporting the lower section 18*a* of the second water muffler 18 is supported by the hull 51 and the bracing flotation member 66 supporting the upper section 47*a* of the second water muffler 18 is supported by the deck 52. In this way, the flotation member supporting the second water muffler 18 is constituted by two members of the bottom section flotation member 56 and the bracing flotation member 66. Therefore, it is possible to maintain a simple shape for the flotation member supporting the second water muffler 18.

Furthermore, cooling water is contained within the first water muffler 18. It is possible to cool the first water muffler 18 using this cooling water and the first water muffler 18 can therefore be kept from reaching a high temperature.

The bottom section flotation member 56 and the bracing flotation member 66 supporting the first water muffler 18 therefore do not reach high temperatures. As a result, it is possible to form the bottom section flotation member 56 and the bracing flotation member 66 using material that is not particularly resistant to high temperatures.

Figure 5:
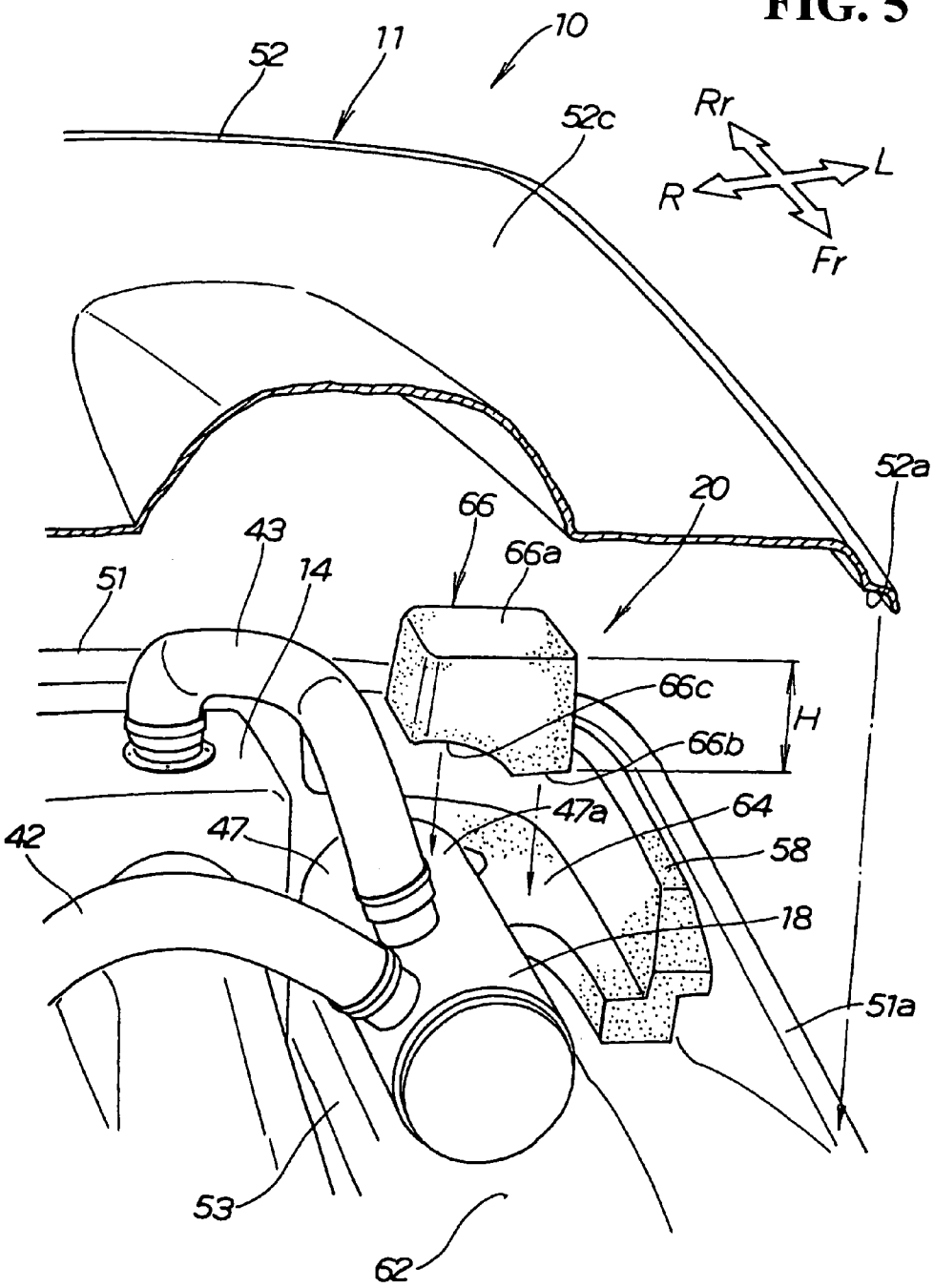
FIG. 5 is an exploded perspective view showing a muffler support structure for a small boat of the present invention.

FIG. 5 is an exploded perspective view showing a muffler support structure for a small boat of the present invention. The muffler support structure 20 of the small boat is such that the second water muffler 18 is mounted on the left recess 62 (also refer to FIG. 4) of the support plate 53 and the bracing flotation member (flotation member) 66 is mounted on the upper section 47*a* of the member 47 of the rear half of the second water muffler 18. The bonding surface 52*a* of the deck 52 is bonded to the bonding surface 51*a* of the hull 51 using adhesive (not shown). The upper end 66*a* of the bracing flotation member 66 is therefore pushed by the deck 52, and the second water muffler 18 is pushed towards the left recess 62 by the bracing flotation member 66 so that the second water muffler 18 is therefore fixed within the boat body 11.

The bracing flotation member 66 is formed substantially rectangular in shape. An upper end 66*a* is formed so as to be flat (refer to FIG. 2 and FIG. 4). A recess 66*c* is formed in the bottom section 66*b*. Furthermore, the bracing flotation member 66 is formed so that the recess 66*c* comes into contact with the upper section 47*a* of the member 47 of the rear half of the second water muffler 18, while the bottom section 66*b* is mounted on the recess 64.

In addition, the height H of the bracing flotation member 66 is set such that when the bottom section 66*b* is mounted on the recess 64, while the bonding surface 52*a* of the deck 52 is bonded with the bonding surface 51*a* of the hull 51, the upper end 66*a* is pressed by a rear flat section 52*c* of the deck 52.

The bracing flotation member 66 is provided as buoyancy material for the boat body 11. The bracing flotation member 66 doubles as a member for fixing the second water muffler 18. It is possible to reduce the number of members required to fix the second water muffler 18 by utilizing the bracing flotation member as the member for fixing the second water muffler 18.

Figure 6A:
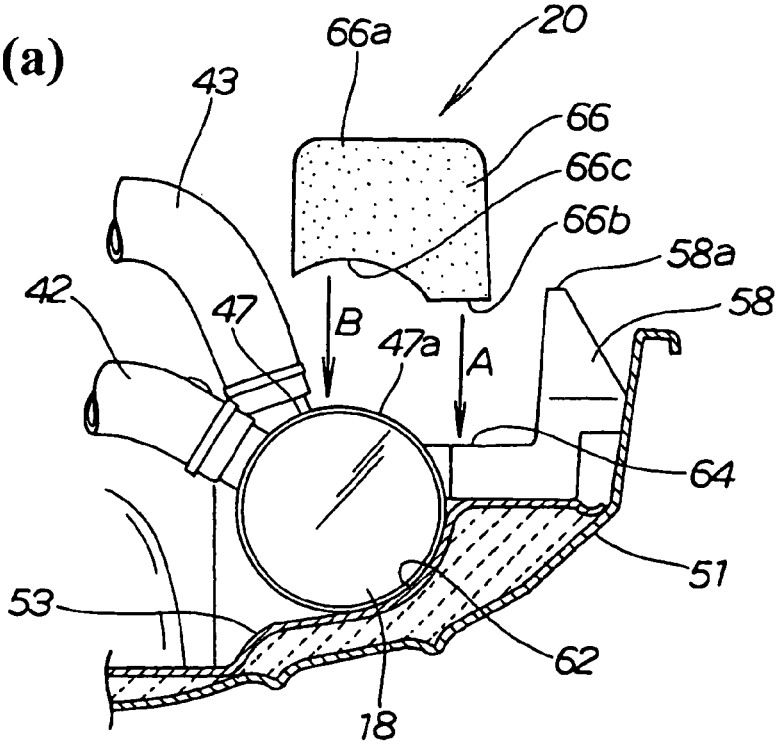
FIG. 6 is a view illustrating an example of installing a bracing flotation member in a procedure for assembling the muffler support structure of the present invention.
Figure 6B:
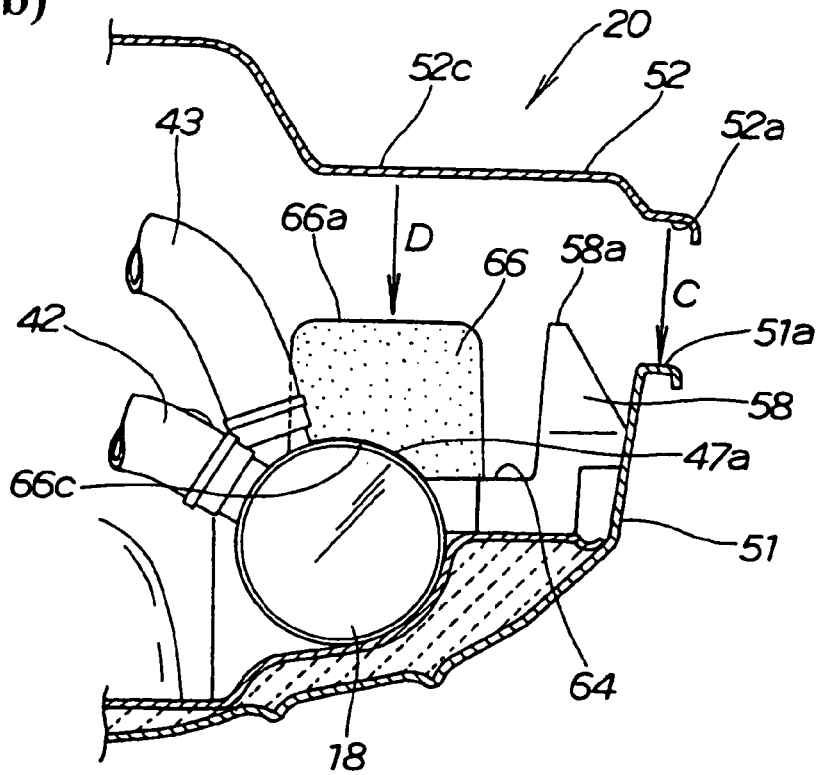

A description will now be given of a procedure for assembling the muffler support structure 20 of the small boat based on FIGS. 6(*a*) and 6(*b*). FIGS. 6(*a*) and 6(*b*) are views illustrating an example for installing the bracing flotation member in the procedure for assembling the muffler support structure of the present invention. In FIG. 6(*a*), an external periphery flotation member 58 is mounted within the hull 51 and the second water muffler 18 is mounted at the left recess 62 of the support plate 53.

The bracing flotation member 66 is then installed. Specifically, the lower end 66*b* of the bracing flotation member 66 is mounted on the recess 64 of the outer periphery flotation member 58. The recess 66*c* of the bracing flotation member 66 is mounted on the upper section 47*a* of the member 47 of the rear half of the second water muffler 18 as shown by the arrow B.

The lower end 66*b* of the bracing flotation member 66 is capable of being bonded using adhesive, for example, to the recess 64 while mounted on the recess 64 of the external periphery flotation member 58.

In FIG. 6(*b*), the deck 52 is installed after applying adhesive (not shown) to the bonding surface 51*a* of the hull 51. Specifically, the bonding surface 52*a* of the deck 52 is mounted on the bonding surface 51*a* of the hull 51 as shown by the arrow C.

At the same time, the flat surface 52*c* of the rear end of the deck 52 is mounted on the upper end 66*a* of the bracing flotation member 66 as shown by the arrow D.

Figure 7:
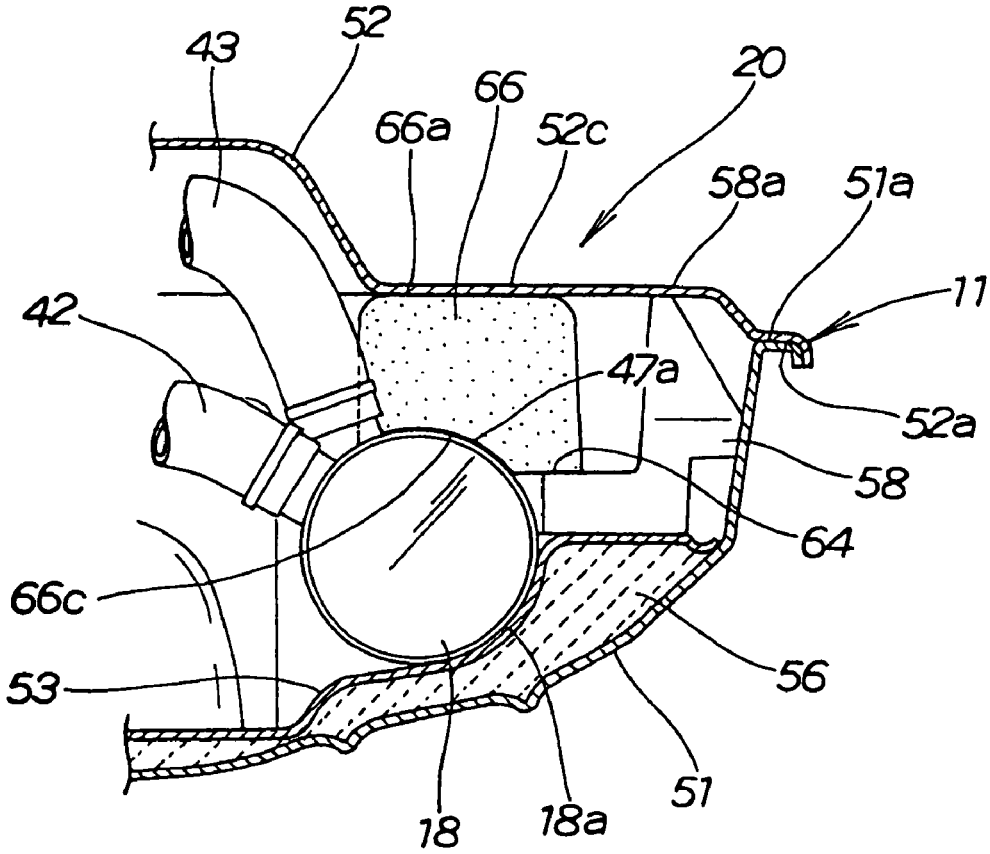
FIG. 7 is a view illustrating an example of a bracing flotation member in a procedure for assembling the muffler support structure of the present invention being pressed by a hull.

FIG. 7 is a view illustrating an example where the bracing flotation member is pushed by the hull in the procedure for assembling the muffler support structure of the present invention. The upper end 66*a* of the bracing flotation member 66 is pushed by the deck 52 while the deck 52 covers the hull 51 as a result of the bonding surface 52*a* of the deck 52 being bonded to the bonding surface 51*a* of the hull 51. The second water muffler 18 is then pushed onto the left recess 62 (see FIG. 4) by the bracing flotation member 66.

The second muffler 18 is therefore supported in a fixed state as a result of the lower section 18*a* of the second water muffler 18 being supported by the bottom section flotation member 56 via the support plate 53 and the upper end 47*a* of the second water muffler 18 being supported by the bracing flotation member 66.

As described above, according to the muffler support structure 20 of the small boat, the second water muffler 18 is fixed within the boat body 11 as a result of the second water muffler 18 being pushed toward the hull 51 side by the bracing flotation member 66. It is therefore not necessary to use any further fixing members to fix the second water muffler within the boat body 11. As a result, it is possible to simplify the manufacturing process for fixing the second water muffler 18.

In addition, according to the muffler support structure 20 for a small boat, by supporting the second water muffler 20 of a large diameter using the bottom section flotation member 56 and the bracing flotation member 66, fixing using a rubber band as in the related art is no longer necessary. As a result, it is possible to fix the second water muffler 18 of a large diameter using a trouble-free straightforward procedure.

In the above embodiment, a description is given of when the portion 47 of the rear half of the second water muffler 18 is supported by the bracing flotation member 66. However, the member supported by the bracing flotation member 66 is not limited to the member 47 of the rear half and may be arbitrarily set.

Furthermore, in this embodiment, a description is given where the bracing flotation member 66 is substantially rectangular in shape but this is not limiting and it is also possible to decide the shape of the bracing flotation member 66 in an arbitrary manner.

Furthermore, in the aforementioned embodiment, an example is described where a support plate 53 is fitted to the hull 51, a bottom section flotation member 56 is provided between the hull 51 and the support plate 53, and a second water muffler 18 is mounted at the support plate 53. However, it is also possible to provide the bottom section flotation member 56 on the hull 51, and directly mount the second water muffler 18 on the bottom section flotation member 56.

The muffler support structure of the present invention is appropriate for application to a small boat where a boat body is constituted by a hull and a deck, and a muffler is provided within the boat body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler support structure for a boat, comprising:

a boat body including a hull and a deck, the deck covering the hull;

a flotation member provided as buoyancy material within the boat body;

an engine;

an exhaust pipe fastened to the engine; and a muffler provided midway along the exhaust pipe, wherein the muffler and the deck are separated by the flotation member, the muffler is fixed using the flotation member, the flotation member being a single piece having a top surface and a bottom surface, the top surface being fully in contact with the deck, the bottom surface including a recess surface in contact with a top half portion of the muffler.

2. A muffler support structure for a boat, comprising:

a boat body including a hull and a deck, the deck covering the hull;

a flotation member provided as buoyancy material within the boat body;

an engine;

an exhaust pipe fastened to the engine; and a muffler provided midway along the exhaust pipe, wherein the flotation member is interposed between the muffler and the deck, and the muffler is fixed using the flotation member, and wherein the muffler is pushed towards the hull side by the flotation member when the hull is covered by the deck, the flotation member being a single piece having a top surface and a bottom surface, the top surface being fully in contact with the deck, the bottom surface including a recess surface in contact with a top half portion of the muffler.

3. The muffler support structure according to claim 1, wherein a first member of the flotation member supports a lower part of the muffler and is supported by the hull, and a second member of the flotation member supports an upper part of the muffler and is supported by the deck.

4. The muffler support structure according to claim 2, wherein a first member of the flotation member supports a lower part of the muffler and is supported by the hull, and a second member of the flotation member supports an upper part of the muffler and is supported by the deck.

5. The muffler support structure according to claim 1, wherein the muffler is a water muffler containing cooling water.

6. The muffler support structure according to claim 2, wherein the muffler is a water muffler containing cooling water.

7. The muffler support structure according to claim 3, wherein the muffler is a water muffler containing cooling water.

8. The muffler support structure according to claim 4, wherein the muffler is a water muffler containing cooling water.

9. The muffler support structure according to claim 1, wherein a support plate is located between the muffler and the flotation member.

10. The muffler support structure according to claim 1, wherein the muffler is supported within the boat body by only the flotation member.

11. A muffler support structure for a boat, comprising:

a boat body including a hull and a deck, the deck covering the hull; and a flotation member including a first supporting member located adjacent the hull and a second supporting member located adjacent to the deck, the first and second supporting members being made of buoyancy material and being spaced apart from each other to provide a space between the first supporting member and the second supporting member capable of receiving a muffler therein to support the muffler within the boat body, wherein the second supporting member is a single piece having a top surface and a bottom surface, the top surface being fully in contact with the deck, the bottom surface including a recess surface in contact with a top half portion of the muffler.

12. The muffler support structure according to claim 11, wherein the muffler is pushed towards the hull side by the second supporting member when the hull is covered by the deck.

13. The muffler support structure according to claim 11, wherein the muffler is a water muffler containing cooling water.

14. The muffler support structure according to claim 12, wherein the muffler is a water muffler containing cooling water.

15. The muffler support structure according to claim 11, wherein a support plate is located between the muffler and the first support member.

16. The muffler support structure according to claim 12, wherein a support plate is located between the muffler and the first support member.

17. The muffler support structure according to claim 11, wherein the muffler is supported within the boat body by only the flotation member.

18. The muffler support structure according to claim 12, wherein the muffler is supported within the boat body by only the flotation member.

19. The muffler support structure according to claim 1, wherein the top surface is substantially flat, and the recess surface is fully in contact with the top half portion of the muffler.

20. The muffler support structure according to claim 19, wherein the bottom surface further includes a flat surface in contact with an outer periphery flotation member, and the outer periphery flotation member is located between and in contact with the deck and a support plate above the hull.

21. The muffler support structure according to claim 2, wherein the top surface is substantially flat, and the recess surface is fully in contact with the top half portion of the muffler.

22. The muffler support structure according to claim 21, wherein the bottom surface further includes a flat surface in contact with an outer periphery flotation member, and the outer periphery flotation member is located between and in contact with the deck and a support plate above the hull.

23. The muffler support structure according to claim 11, wherein the top surface is substantially flat, and the recess surface is fully in contact with the top half portion of the muffler.

24. The muffler support structure according to claim 23, wherein the bottom surface further includes a flat surface in contact with an outer periphery flotation member, and the outer periphery flotation member is located between and in contact with the deck and a support plate above the hull.

25. The muffler support structure according to claim 1, wherein the exhaust pipe is fastened to the top half portion of the muffler and one side of the muffler in a longitudinal direction thereof, and the floating member is in contact with another side of the muffler in the longitudinal direction thereof.

* * * * *